US005977695A

United States Patent [19]

Osamura et al.

[11] Patent Number: 5,977,695

[45] Date of Patent: Nov. 2, 1999

[54] SPARK PLUG HAVING IMPROVED CONSUMPTION RESISTANCE

[75] Inventors: Hironori Osamura, Chiryu; Nobuo Abe, Yokkaichi, both of Japan

[73] Assignee: Denso Corporation, Kariya, Japan

[21] Appl. No.: 08/855,472

[22] Filed: May 13, 1997

[30] Foreign Application Priority Data

May 13, 1996 [JP] Japan ..... 8-117980
Apr. 15, 1997 [JP] Japan ..... 9-97646

[51] Int. Cl.[6] ..... H01T 13/20

[52] U.S. Cl. ..... 313/141

[58] Field of Search ..... 313/141

[56] References Cited

U.S. PATENT DOCUMENTS

| | | | |
|---|---|---|---|
| 3,967,149 | 6/1976 | Eaton et al. | 313/141 |
| 3,984,717 | 10/1976 | Romanowski et al. | 313/141 |
| 4,122,366 | 10/1978 | Von Stutterheim et al. | 313/141 |
| 4,229,672 | 10/1980 | Trancik | 313/139 |
| 4,324,588 | 4/1982 | Zysk et al. | 75/208 R |
| 4,427,915 | 1/1984 | Nishio et al. | 313/141 |
| 4,743,793 | 5/1988 | Toya et al. | 313/141 |
| 4,771,209 | 9/1988 | Ryan | 313/140 |
| 4,893,051 | 1/1990 | Kondo | 313/141 |
| 5,514,929 | 5/1996 | Dawamura | 313/141 |

FOREIGN PATENT DOCUMENTS

| | | |
|---|---|---|
| 0 400 950 | 5/1990 | European Pat. Off. . |
| 62-58114 | 12/1987 | Japan . |
| 63-257193 | 10/1988 | Japan . |
| 64-11579 | 2/1989 | Japan . |
| 3-001475 | 1/1991 | Japan . |
| 4-329286 | 11/1992 | Japan . |
| 5-343156 | 12/1993 | Japan . |
| 6-112261 | 4/1994 | Japan . |
| 7-268574 | 10/1995 | Japan . |

*Primary Examiner*—Vip Patel
*Assistant Examiner*—Matthew J. Gerike
*Attorney, Agent, or Firm*—Pillsbury Madison & Sutro LLP

[57] ABSTRACT

To provide a spark plug having an improved consumption resistance and producible through a simple process, a spark plug comprises a noble metal chip composed of an Ir alloy material and disposed on at least one of the tip of the center electrode and the facing portion of the ground electrode, the Ir alloy material is composed of Ir and a metal having a higher oxidation resistance than Ir and forming solid solution with Ir at all proportions to prevent oxidation evaporation of Ir, and the chip is produced by elongating an ingot of the Ir alloy material through hot forging to a bar having a fine fiber texture to prevent surface cracking during elongation, followed by hot rolling, hot wire drawing and cutting to the chip length.

4 Claims, 4 Drawing Sheets

SPARK PLUG HAVING IMPROVED CONSUMPTION RESISTANCE

BACKGROUND OF THE INVENTION

1. Field of the Invention

The present invention relates to a spark plug which has an improved service life and is suitably used in an automobile combustion engine.

2. Description of the Related Art

Japanese Unexamined Patent Publication (Kokai) No. 5-343156 proposed a Pt-coated Ir material composed of an Ir wire having a diameter of 0.8 mm and having a circumferential surface coated with a 0.08 mm thick Pt coating. The Pt-coated Ir material is produced by melting an Ir powder, casting the melt to form an ingot, hot-working the ingot to an elongated wire having a diameter of 4 mm, inserting the wire in a Pt pipe and heating the assembly to form a Pt coating over the circumferential surface of the wire.

The proposed Pt-coated Ir material prevents consumption of Ir due to oxidation evaporation at elevated temperatures (hereinafter referred to as "oxidation consumption") and is advantageously disposed at the tip of a center electrode of a spark plug to provide an improved service life of the spark plug.

However, the Pt-coated Ir material has a problem in that the production process is complicated and the production cost is inevitably increased because of the necessity of an additional step of forming the Pt coating and the necessity of an expensive Pt pipe.

SUMMARY OF THE INVENTION

An object of the present invention is to solve the problem of the prior art technology and to provide a spark plug which has an improved consumption resistance and is producible through a simple process.

Another object of the present invention is to provide a process of producing the spark plug without complicated process steps.

The present inventors completed the present invention based on the novel finding that oxidation of Ir at elevated temperatures is prevented by the use of an Ir alloy material composed by adding to Ir a metal having a higher oxidation resistance than Ir and forming a solid solution with Ir at all proportions and the Ir alloy material can be hot-worked without causing surface cracking.

To achieve the object according to the present invention, there is provided a spark plug comprising:

a center electrode;

an insulator circumferentially enclosing the center plug, leaving a tip of the center plug exposed;

a holder circumferentially holding the insulator, leaving a tip of the insulator exposed;

a ground electrode fixed to the holder and having a facing portion facing the tip of the center electrode with a discharging gap interposed therebetween;

a chip composed of an Ir alloy material and disposed on at least one of the tip of the center electrode and the facing portion of the ground electrode, said Ir alloy material being produced by mixing Ir with a metal to form a mixture and melting the mixture, said metal having a higher oxidation resistance than Ir and forming solid solution with Ir at all proportions; and said chip being produced by elongating an ingot of the Ir alloy material through hot forging to a bar having a selected cross section and then cutting a wire drawn from the bar to a selected length.

The metal preferably has a melting point of from 1700° C. to 2400° C. and a heat conductivity of 0.1 cal/(cm-s-° C.) or more and the chip contains the metal in an mount of from 1 wt % to 30 wt %.

The chip preferably has a cross-sectional area of from 0.2 $mm^2$ to 1.2 $mm^2$ and a length of from 0.5 mm to 2.0 mm.

The metal typically consists of at least one selected from the group consisting of Pt, Rh and Ru.

According to the present invention, there is also provided a process of producing a chip for a spark plug including an insulator circumferentially enclosing the center plug, leaving a tip of the center plug exposed; a holder circumferentially holding the insulator, leaving a tip of the insulator exposed; a ground electrode fixed to the holder and having a facing portion facing the tip of the center electrode with a discharging gap interposed therebetween; a chip composed of an Ir alloy material and disposed on at least one of the tip of the center electrode and the facing portion of the ground electrode; said Ir alloy material being produced by mixing Ir with a metal to form a mixture and melting the mixture, said metal having a higher oxidation resistance than Ir and forming solid solution with Ir at all proportions; and said chip being produced by elongating an ingot of the Ir alloy material through hot forging to a bar having a selected cross section and then cutting a wire drawn from the bar to a selected length, said process comprising the steps of:

mixing Ir and the metal to form a mixture;

melting the mixture to form a melt;

casting the melt to form an ingot;

hot-forging the ingot to form a forged bar;

hot-rolling the forged bar to a hot-rolled bar having a reduced cross section;

hot-wire drawing the hot-rolled bar to a wire having a selected circular cross section; and cutting the wire to a selected length.

There is further provided a process of producing a chip of a spark plug including an insulator circumferentially enclosing the center plug, leaving a tip of the center plug exposed; a holder circumferentially holding the insulator, leaving a tip of the insulator exposed; a ground electrode fixed to the holder and having a facing portion facing the tip of the center electrode with a discharging gap interposed therebetween; a chip composed of an Ir alloy material and disposed on at least one of the tip of the center electrode and the facing portion of the ground electrode; said Ir alloy material being produced by mixing Ir with a metal to form a mixture and melting the mixture, said metal having a higher oxidation resistance than Ir and forming solid solution with Ir at all proportions; and said chip being produced by elongating an ingot of the Ir alloy material through hot forging to a bar having a selected cross section and then cutting a wire drawn from the bar to a selected length, said process comprising the steps of:

mixing Ir and the metal to form a mixture;

melting the mixture to form a melt;

casting the melt to form an ingot;

hot-forging the ingot to form a forged bar;

hot-rolling the forged bar to a hot-rolled bar having a reduced cross section;

hot-wire drawing the hot-rolled bar to a wire having a selected polygonal cross section; and cutting the wire to a selected length.

In the processes according to the present invention, the step of cutting the wire is preferably carried out by abrasion of the wire with an abrasive.

A chip consisting of the Ir alloy material according to the present invention is disposed on at least one of the tip of center electrode and the facing portion of a ground electrode of a spark plug.

A metal has a higher oxidation resistance than Ir if the metal has an oxidation consumption less than that of Ir at elevated temperatures. The present inventors confirmed that Ir has an oxidation consumption of about 0.5 mg/(cm$^2$-h) at about 1000° C., i.e., a temperature at or near a chip of a spark plug when discharging. A metal can be considered to have a significantly higher oxidation resistance than that of Ir if the metal has an oxidation consumption of less than about $1\times10^{-2}$ mg/(cm$^2$-h) at about 1000° C.

Specifically, Pt has an oxidation consumption of about $1\times10^{-5}$ mg/(cm$^2$-h), Ru has an oxidation resistance of about $1\times10^{-2}$ mg/(cm$^2$-h), and Rh has an oxidation resistance of about $1\times10^{-4}$ mg/(cm$^2$-h).

A metal forms a solid solution with Ir at all proportions if the metal is dissolved together with Ir to form a homogeneous solid solution over all proportions thereof. An ingot composed of an Ir alloy material of a homogeneous solid solution of this kind of metal and Ir has no parts in which Ir is segregated and oxidation evaporation of Ir from such parts does not occur.

It is also advantageous that Pt, Rh and Ru have a lower hardness than Ir and are more ductile than Ir, so that an Ir alloy containing at least one of Pt, Rh and Ru has a lower hardness than Ir and is more ductile than Ir to allow an ingot of the Ir alloy to be elongated without causing surface cracking.

According to the present invention, an ingot of the Ir alloy is elongated to a bar through hot forging to eliminate blow holes and other rough structures in the ingot to provide a fine fiber texture, which also prevents surface cracking from occurring during elongation of the ingot.

A bar produced by elongating the Ir alloy material has a tensile strength which is reduced as the amount of surface cracks is increased. Therefore, the amount of surface cracks of a bar or wire is evaluated by measurement of the tensile strength of the bar or wire.

A chip of the present invention is produced in the following process sequence. An ingot as described above is first prepared, hot-forged to a forged bar having a fine fiber texture, and the forged bar is then hot-rolled to a bar having a reduced cross section. The hot-rolled bar is then hot-wire drawn to a wire having a selected circular or polygonal cross section and the wire is cut to a selected length.

A chip having a circular cross section is advantageous because it can be laser-welded to a center electrode without limiting the laser welding points.

A chip having a polygonal cross section is also advantageous because it causes concentration of an electric field to a corner thereof to reduce the discharging voltage of a spark plug.

A wire having a selected circular or polygonal cross section is advantageously cut by abrasion thereof with an abrasive to prevent undesirable formation of burrs, cracks, or unevenness on the cut surface.

It should be also noted that a bar having a fine fiber texture has a high tensile strength than those not having a fine fiber texture, which was shown by an experiment conducted by the present inventors as will be herein described later. Therefore, a bar having a fine fiber texture prevents occurrence of the surface cracking and can be hot-rolled and hot-wire drawn without occurrence of breakage thereof.

The metal to be alloyed with Ir according to the present invention preferably has a melting point of from 1700° C. to 2400° C.

If the metal has a melting point of lower than 1700° C., the chip volume consumption upon discharging amounts to more than $1.5\times10^{-9}$ mm$^3$ per spark discharge (hereinafter referred to as "chip consumption") as shown by an experiment as will be herein described later, causing enlargement of a discharging gap and unsatisfactory sparking even before an automobile travels a distance of 100,000 km.

If the metal has a melting point of higher than 2400° C., the process of melting Ir cannot melt the metal and a substantially higher melting temperature is necessary.

It is also preferable that the metal has a heat conductivity of 0.1 cal/(cm-s-° C.) or more.

If the metal has a heat conductivity of less than 0.1 cal/(cm-s-° C.), the chip consumption will be more than $1.5\times10^{-9}$ mm$^3$ as can be seen from the experimental result herein described later.

A chip of the present invention preferably contains the metal in an amount of from 1 wt % to 30 wt %.

If the metal content of chip is less than 1 wt %, the chip will have a tensile strength of less than 40 kg/mm$^2$ as can be seen from the experimental result herein described later, so that the chip may be damaged by an impact during assembly of a spark plug, as occasionally experienced by the present inventors.

On the other hand, if the metal content of chip is more than 30 wt %, the chip consumption is more than $1.5\times10^{-9}$ mm$^3$ as can be seen from the experimental result herein described later.

It is also preferable that a chip of the present invention has a cross-sectional area of from 0.2 mm$^2$ to 1.2 mm$^2$ and a length of from 0.5 mm to 2.0 mm.

If a chip has a cross-sectional area of less than 0.2 mm$^2$ and a length of more than 2.0 mm, heat extraction through a chip from the discharging gap side to the center electrode side thereof is poor during operation of a spark plug and causes an abnormal increase in the temperature of the chip on the discharging gap side and an increase in the chip consumption, with the result that a specified long service life of chip cannot be satisfied as experienced by the inventors.

On the other hand, if a chip has a cross-sectional area of more than 1.2 mm$^2$, electric field concentration of a chip on the discharging gap side is poor and causes an increase in the discharging voltage of a spark plug as experienced by the inventors.

As a spark is formed on the discharging side surface of a chip, and if the chip has a length of less than 0.5 mm, the spark is close to a center electrode and is cooled by the center electrode (hereinafter referred to as "spark quench"), with the result that the ignitability of spark plug is lowered as experienced by the inventors.

DESCRIPTION OF THE PREFERRED EMBODIMENTS

EXAMPLE 1

Figure 1:
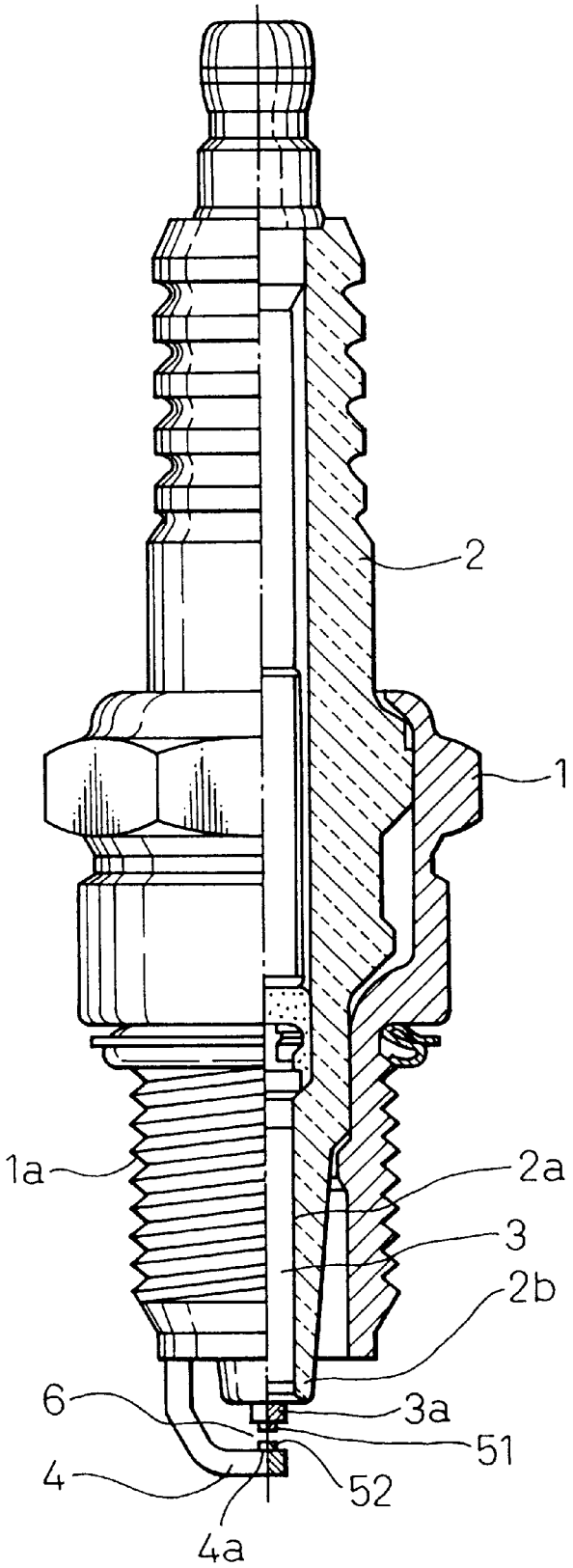
FIG. 1 is a half cross-sectional, half elevation view of a spark plug of Example 1 according to the present invention.

FIG. 1 is a half cross-sectional, half elevation view of a spark plug according to the present invention, in which the spark plug includes a hollow cylindrical holder 1 having an attaching thread 1*a* for mounting on an internal combustion engine. The holder 1 encloses an insulator 2 of alumina ceramic ($Al_2O_3$) or the like fixed thereto and having an axial hollow 2*a* enclosing a center electrode 3 fixed thereto. The insulator 2 has a tip 2*b* exposed from the holder 1.

The center electrode 3 is in the form of a solid cylinder composed of an inner portion made of copper or other metal material having good heat conductivity and an outer portion made of nickel or other metal material having good heat and corrosion resistance. The center electrode 3 has a tip 3*a* exposed from the tip 2*a* of the insulator 2.

A ground electrode 4 is welded to one end of the holder 1 and faces the tip 3*a* of the center electrode 3 via a discharging gap 6 interposed therebetween. The ground electrode 4 is made of a Ni-based alloy or other metal material.

A noble metal chip 51 made of an Ir alloy material according to the present invention is disposed on the tip 3*a* of the center electrode 3. The chip 51 is in the form of a solid cylinder consisting of 95 wt % Ir and 5 wt % Rh (hereinafter abbreviated as "95Ir-5Rh"). Rh forms a solid solution with Ir at all proportions and is superior to Ir in oxidation resistance. The chip 51 has a diameter of 0.7 mm and a length of 1.5 mm, for example, to ensure both heat extraction from the chip 51 and spark quench for the center electrode 3 and the ground electrode 4.

Figure 2:
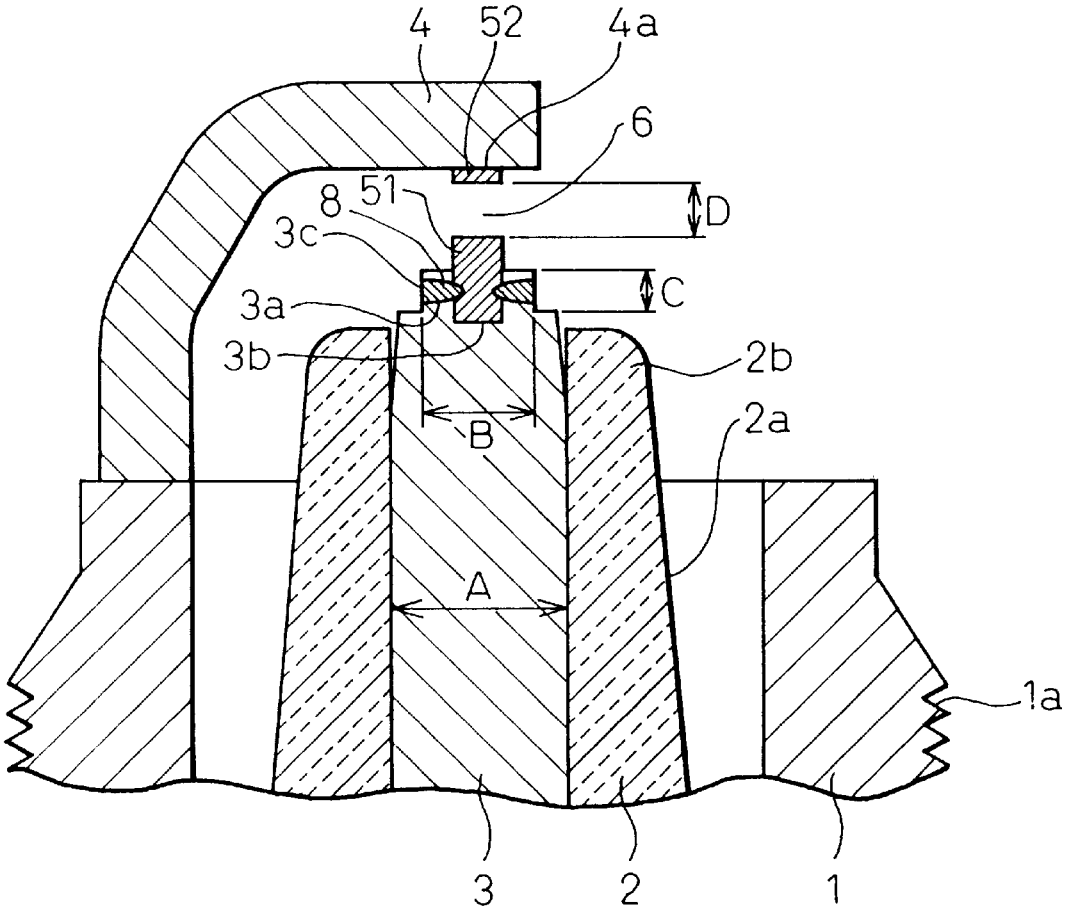
FIG. 2 is an enlarged partial cross-sectional view of a spark plug of Example 1 according to the present invention.

FIG. 2 shows the spark plug of FIG. 1 in an enlarged partial cross-sectional view, in which the tip 3*a* of the center electrode 3 has a reduced diameter portion 3*c* having a hole 3*b* formed therein. The noble metal chip 51 is fixed to the tip 3*a* by inserting part of the chip 51 in the hole 3*b*, radially staking the tip 3*a*, and then laser welding the tip 3*a* to form a fused layer 8. The laser welding is performed radially toward the axis of the reduced diameter portion 3*c* at eight points with an interval of 45° along the periphery of the reduced diameter portion 3*c*. The reduced diameter portion 3*c* is provided to ensure satisfactory formation of the fused layer 8 sufficient for bonding the noble metal chip 51 to the center electrode 3.

Facing the tip 3*a* of the center electrode 3, the ground electrode 4 has a facing portion 4*a* having a noble metal chip 52 fixed thereto by resistance welding. The noble metal chip 52 is also in the form of a solid cylinder made of a 78Pt-20Ir-2Ni alloy. The chip 52 has a diameter of 0.7 mm (a cross-sectional area of about 0.4 $mm^2$) and a length of 0.3 mm. Generally, the noble metal chip 51 of the center electrode 3 is much more consumed by a spark discharge than the chip 52 of the ground electrode 4. Therefore, in this example, the chip 51 is made of an Ir alloy material according to the present invention whereas the chip 52 is made of a conventional material.

Figure 3:
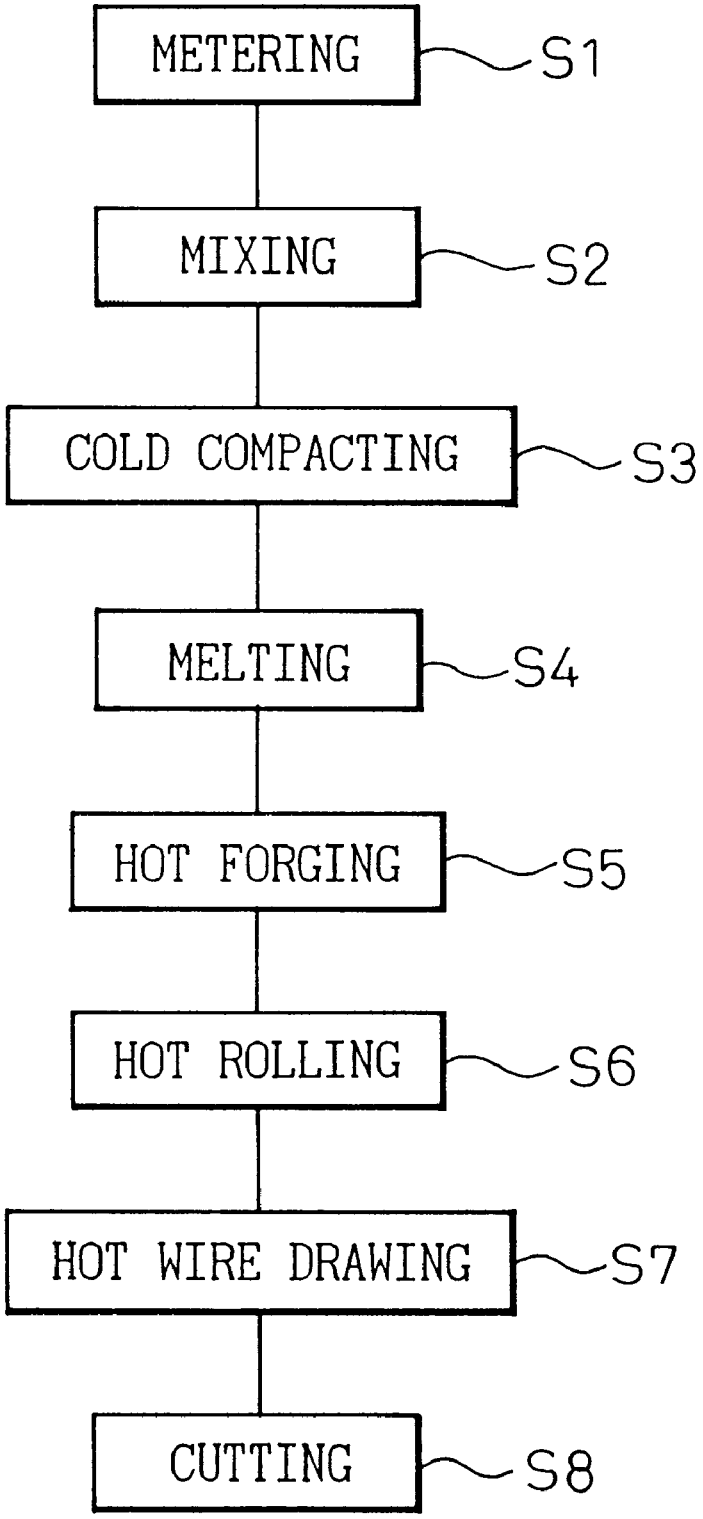
FIG. 3 is a flow chart of a process of producing a noble metal chip of Example 1 according to the present invention.
Figure 4A:
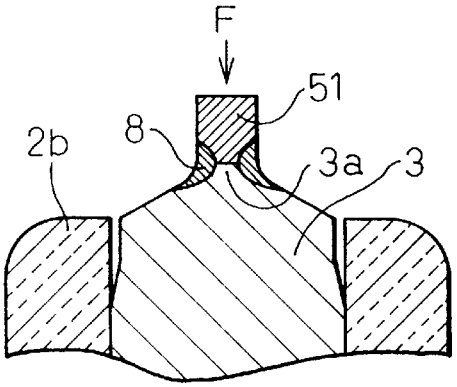
FIG. 4(*a*) is a cross-sectional view of spark plugs of Examples 2 to 4 according to the present invention and FIGS. 4(*b*) to 4(*d*) are plan views of spark plugs of FIG. 4(*a*) viewed in the direction of arrow F.
Figure 4B:
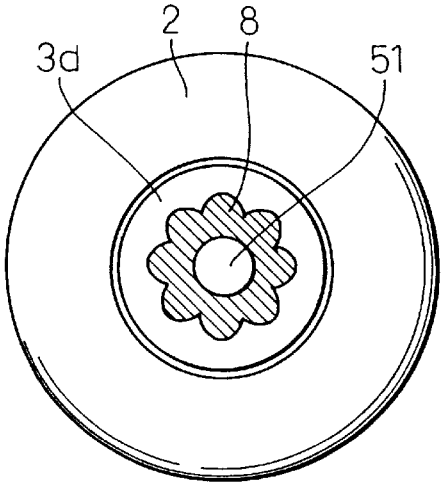
Figure 4C:
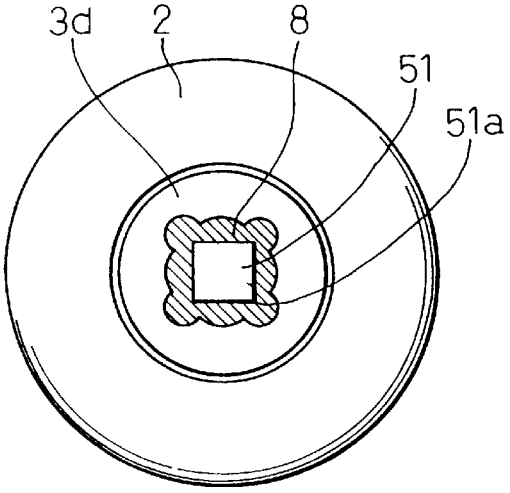
Figure 4D:
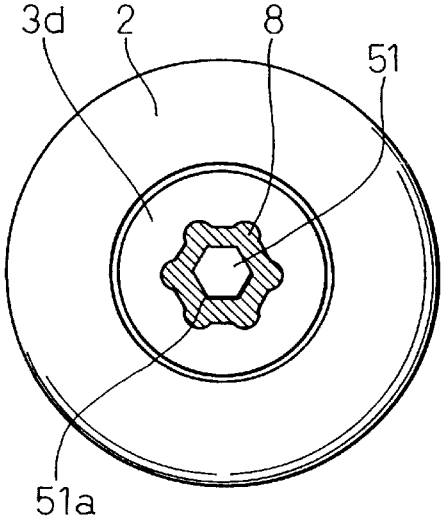

The noble metal chip 51 according to the present invention is produced through the process steps shown in FIG. 3.

760g of an Ir powder having a particle diameter of about 10 $\mu$m and 40 g of an Rh powder having a particle diameter of about 10 $\mu$m are metered (FIG. 3, S1) and mixed to form a powder mixture (FIG. 3, S2). The powder mixture is cold-compacted, for example at about 25° C., to form a solid substantially in the form of a rectangular parallelepiped (FIG. 3, S3).

The thus-formed solid compact is placed in a mold cavity in the form of a rectangular parallelepiped having dimensions of 40 mm×100 mm×10 mm and melted there by arc melting at a temperature higher than the melting point of Ir (2454° C.), for example at about 2500° C. (FIG. 3, S4). This yields an ingot in the form of a rectangular parallelepiped having a cross section of 40 mm×100 mm and a height of about 10 mm.

The ingot is allowed to cool to a temperature at which it loses fluidity but can be plastically deformed, for example about 1300° C., and is then hot-forged by a steel hammer to form a square bar having dimensions of about 10 mm×10 mm (FIG. 3, S5). The hot forging is performed by pressing the ingot at a pressure of $10^4$ to $10^5$ kg/$cm^2$, for example, i.e., at a sufficiently high pressure to eliminate blow holes and other rough structures of the ingot and to yield a square bar having a fine fiber texture.

The hot-forged square bar is then hot-rolled repeatedly at a reduction in area of about 95% using a grooved roll to form a square bar having a reduced cross section of about 1 mm×1 mm (referred to as "small cross section bar") (FIG. 3, S6). During rolling, the grooved roll is maintained at about 700° C. (a proof temperature of the roll used) and the bar is maintained at about 1300° C. It is preferred that, if the roll has a proof temperature of higher than 700° C., the roll is maintained at a temperature closer to the temperature of the bar.

The small section square bar is then hot-wire drawn repeatedly at a reduction in area of about 99% using a circular die to form a wire having a diameter of 0.7 mm (or a bar having a circular cross section) (FIG. 3, S7). During wire drawing, the die is maintained at about 700° C. (a proof temperature of the die used) and the bar or wire is maintained at about 1300° C. The hot-drawn wire is then cut to a selected temporary length of 10 cm, for example, is allowed to cool to room temperature, and is further cut by abrasion cutting to a selected final length of 1.5 mm, for example (FIG. 3, S8). This yields a noble metal chip 51.

Abrasion cutting is a cutting by abrasion of a wire and is typically performed by an abrasion cutter having a piano wire ring of a wire diameter of 0.2 mm, for example, the wire surface having an abrasive such as 1 $\mu$m diamond abrasive grains bonded thereon. A plurality of the piano wire rings are disposed parallel to each other and engaged in pulleys arranged in parallel at a selected interval corresponding to the selected final length, i.e., the length of the noble metal chip 51.

The wires of the temporary length are bundled in a selected number, for example 50 wires, and the bundled wires are integrated in a resin to form a resin cake, which is then kept against the piano wire rings rotating in the same sense until it is abrasion-cut to plural cakes. The resin of the abrasion-cut cake is then burnt away to yield the selected number of the noble metal chips 51.

A water jet type abrasion cutter, in which water containing abrasive grains is sprayed in a line form, may also be used.

Referring to Table 1, experiments, in which tensile strength and consumption of chips composed of Ir alloyed with different metals were measured, will be described below. Table 1 contains the data for the melting point and heat conductivity of the metal to be alloyed with Ir and also shows whether or not hot forging was performed, for Samples 1 to 9 according to the present invention and Comparative Samples C1 to C15. Regarding Comparative Samples C1 and C2, the melting point and heat conductivity of Ir is shown in Table 1.

Samples 1 to 9 and Comparative Samples C1 to C15

Noble metal chips of Samples 1 to 9 and Comparative Samples C1 to C15 had the alloy compositions shown in Table 1, a diameter of 1.0 mm (cross-sectional area of about 0.8 $mm^2$) and a length of 2 mm. Two chips were prepared for each of the samples. The noble metal chips of Comparative Samples C1, C5, C8 and C11 were not produced by hot forging (FIG. 3, S5) but were prepared by cutting the above-mentioned ingot to an about 10 mm×10 mm square bar, which was then hot-rolled (FIG. 3, S6) and hot-wire-drawn (FIG. 3, S7).

One of the two chips was used to measure the tensile strength in a uniaxial tensile test. The results are also summarized in Table 1. The other of the two chips was mounted on a spark plug as a chip 51 as shown in FIG. 2 to measure the volume consumption of chip in a 100-hour spark discharging test in which the plug sparked 600 times per minute in a sealed chamber with an internal air pressure maintained at 5 $kgf/cm^2$.

The results were used to calculate the chip consumption per spark as shown in Table 1. The threaded portion 1*a* of the spark plug had a diameter E of 14 mm, the center electrode 3 had a diameter A of 2.5 mm, the tip 3*a* of the center electrode 3 had a diameter B of 1.5 mm and a height C of 1.0 mm, and the discharging gap 6 had a distance D of 1.1 mm.

TABLE 1

| | | Alloying Metal | | | | |
|---|---|---|---|---|---|---|
| No. | Chip alloy composition | Melting point [° C.] | Heat conductivity [cal/(cm-s-° C.)] | Hot forging | Tensile strength [$kgf/mm^2$] | Chip consumption [$10^{-9}$ $mm^3$] |
| 1 | 99Ir-1Pt | 1770 | 0.16 | Executed | 55 | 1.0 |
| 2 | 97Ir-3Pt | " | " | Executed | 63 | 1.2 |
| 3 | 70Ir-30Pt | " | " | Executed | 72 | 1.3 |
| 4 | 99Ir-1Rh | 1970 | 0.21 | Executed | 63 | 0.6 |
| 5 | 97Ir-3Rh | " | " | Executed | 70 | 0.7 |
| 6 | 70Ir-30Rh | " | " | Executed | 78 | 1.0 |
| 7 | 99Ir-1Ru | 2280 | 0.18 | Executed | 68 | 0.7 |
| 8 | 97Ir-3Ru | " | " | Executed | 72 | 0.9 |
| 9 | 70Ir-30Ru | " | " | Executed | 78 | 1.1 |
| C1 | 100Ir | 2454 | 0.14 | No | 15 | 2.8 |
| C2 | 100Ir | 2454 | 0.14 | Executed | 20 | 2.6 |
| C3 | 99.5Ir-0.5Pt | 1770 | 0.16 | Executed | 25 | 1.7 |
| C4 | 50Ir-50Pt | " | " | Executed | 73 | 2.0 |
| C5 | 70Ir-30Pt | " | " | No | 20 | 1.4 |
| C6 | 99.5Ir-0.5Rh | 1970 | 0.21 | Executed | 30 | 1.5 |
| C7 | 50Ir-50Rh | " | " | Executed | 80 | 1.6 |
| C8 | 70Ir-30Rh | " | " | No | 30 | 1.2 |
| C9 | 99.5Ir-0.5Ru | 2280 | 0.18 | Executed | 30 | 1.3 |
| C10 | 50Ir-50Ru | " | " | Executed | 81 | 1.7 |
| C11 | 70Ir-30Ru | " | " | No | 25 | 1.5 |
| C12 | 70Ir-30Pd | 1550 | 0.17 | Executed | 75 | 2.1 |
| C13 | 70Ir-30Ni | 1450 | 0.22 | Executed | 80 | 2.3 |
| C14 | 70Ir-30Ti | 1670 | 0.06 | Executed | 65 | 2.1 |
| C15 | 70Ir-30Hf | 2220 | 0.05 | Executed | 65 | 1.9 |

(Note) Nos. 1–9: present invention.
Nos. C1–C15: comparison.

EXAMPLE 2

As shown in FIG. 4(*a*), a spark plug has a tip 3*a* of a center electrode 3 having a tapered portion 3*d* in which the diameter of the center electrode 3 is gradually reduced to the same size as a noble metal chip 51. The chip 51 is disposed on the end surface of the tapered portion 3*d* and is temporarily fixed to the latter by resistance welding and laser welding is performed to form a fused layer 8 to finally fix the chip 51 to the tip 3*a* of the center electrode 3. As shown in FIG. 4(*b*), the laser welding is performed from a peripheral zone surrounding a contact surface in which the tapered portion 3*d* and the chip 51 are in contact with each other, in the direction inclined at an angle of 45°, for example, to the contact surface, and at eight points with an interval of 45° along the peripheral zone.

EXAMPLE 3

As shown in FIG. 4(*c*), a spark plug has a noble metal chip 51 having a square cross section. A tapered portion 3*d* has a circular top end having a sufficient area to cover the cross section of the chip 51. Laser welding is performed at four points near a contact surface in which the top end surface of the tapered portion 3*d* and the corners 51*a* of the chip 51 are in contact with each other.

The noble metal chip 51 having a square cross section is produced by the same process as in Example 1, except that, in the hot wire drawing step S7, a square die is used to perform wire drawing in which a square bar is hot-wire drawn repeatedly at a reduction in area of about 99% to yield a square wire having a cross sectional edge length of 0.5 mm, for example.

EXAMPLE 4

As shown in FIG. 4(*d*), a spark plug has a noble metal chip 51 having a hexagonal cross section. A tapered portion 3*d* has a circular top end having a sufficient area to cover the cross section of the chip 51. Laser welding is performed at six points near a contact surface in which the top end surface of the tapered portion 3*d* and the corners 51*a* of the chip 51 are in contact with each other.

The noble metal chip 51 having a hexagonal cross section is produced by the same process as in Example 1, except that, in the hot wire drawing step S7, a hexagonal die is used to perform wire drawing in which a square bar is hot-wire drawn repeatedly at a reduction in area of about 99% to yield a hexagonal wire having a cross sectional edge length of 0.35 mm.

We claim:

1. A spark plug comprising:

a center electrode;

an insulator circumferentially enclosing the center electrode, leaving a tip of the center electrode exposed;

a holder circumferentially holding the insulator, leaving a tip of the insulator exposed;

a ground electrode fixed to the holder and having a facing portion facing the tip of the center electrode with a discharging gap defined therebetween;

a chip composed of an Ir alloy material and disposed on at least one of the tip of the center electrode and the facing portion of the ground electrode;

said Ir alloy material being produced by mixing Ir with a metal to form a mixture and melting the mixture, said metal having a higher oxidation resistance than Ir and forming a solid solution with Ir at all proportions, and wherein said Ir alloy material contains 70 to 99 wt % Ir; and said chip being produced by elongating an ingot of the Ir alloy material through hot forging to a bar having a selected cross section and finally cutting a wire drawn from the bar to a selected length.

2. A spark plug according to claim 1, wherein the metal has a melting point of from 1700° C. to 2400° C. and a heat conductivity of 0.1 cal/(cm-s-° C.) or more and the chip contains the metal in an amount of from 1 wt % to 30 wt %.

3. A spark plug according to claim 1 or 2, wherein the chip has a cross-sectional area of from 0.2 $mm^2$ to 1.2 $mm^2$ and a length of from 0.5 mm to 2.0 mm.

4. A spark plug according to claim 1 or 2, wherein the metal consists of at least one selected from the group consisting of Pt, Rh and Ru.

* * * * *